US009364702B2

(12) United States Patent
Staten et al.

(10) Patent No.: US 9,364,702 B2
(45) Date of Patent: Jun. 14, 2016

(54) EXERCISE DEVICE

(71) Applicant: Rogers Athletic Company, Inc., Clare, MI (US)

(72) Inventors: Kenneth Edward Staten, Clare, MI (US); Tyler James Hobson, Montgomery, TX (US); Brian Lesley Staten, Clare, MI (US); Kyle R. Camp, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 149 days.

(21) Appl. No.: 14/271,676

(22) Filed: May 7, 2014

(65) Prior Publication Data

US 2014/0336017 A1 Nov. 13, 2014

Related U.S. Application Data

(60) Provisional application No. 61/855,066, filed on May 7, 2013.

(51) Int. Cl.

| | |
|---|---|
| ***A63B 21/062*** | (2006.01) |
| ***A63B 21/00*** | (2006.01) |
| ***A63B 23/12*** | (2006.01) |
| *A63B 71/00* | (2006.01) |

(52) U.S. Cl.

CPC ..... *A63B 21/062* (2013.01); *A63B 21/00076* (2013.01); *A63B 21/063* (2015.10); *A63B 21/0628* (2015.10); *A63B 21/0632* (2015.10); *A63B 21/154* (2013.01); *A63B 23/129* (2013.01); *A63B 23/1218* (2013.01); *A63B 23/1227* (2013.01); *A63B 23/1254* (2013.01); *A63B 23/1263* (2013.01); *A63B 23/1272* (2013.01); *A63B 23/1281* (2013.01); *A63B 2071/0018* (2013.01); *A63B 2225/09* (2013.01); *A63B 2225/102* (2013.01)

(58) Field of Classification Search

CPC ..... A63B 2071/0018; A63B 21/154; A63B 21/156; A63B 21/285; A63B 21/00076; A63B 21/062; A63B 21/0628; A63B 21/063; A63B 21/0632; A63B 23/03558; A63B 23/03566; A63B 2225/10; A63B 2225/102; A63B 2225/105; A63B 2225/093; A63B 2208/0204; A63B 2208/0209

USPC ..... 482/93–103, 138

See application file for complete search history.

(56) References Cited

U.S. PATENT DOCUMENTS

| | | | | | |
|---|---|---|---|---|---|
| 4,603,855 | A * | 8/1986 | Sebelle | A63B 21/06 | 482/103 |
| 4,765,614 | A | 8/1988 | Shute | | |
| 4,911,435 | A * | 3/1990 | Johns | A63B 21/154 | 280/304.1 |
| 5,044,629 | A | 9/1991 | Ryan et al. | | |
| 5,100,128 | A * | 3/1992 | Mabry | A63B 21/0632 | 482/134 |

(Continued)

*Primary Examiner* — Oren Ginsberg
*Assistant Examiner* — Gregory Winter
(74) *Attorney, Agent, or Firm* — Carlson, Gaskey & Olds, P.C.

(57) ABSTRACT

An example apparatus for a user in a wheelchair includes an exercise device providing an exercise area configured to receive a wheelchair. A primary handle is moveable by a first user in the wheelchair from a first position to a second position. A resistance assembly opposes movement of the at least one primary handle. A spotter handle is coupled to move together with the at least one primary handle. The spotter handle accessible by a second user from a position outside the exercise area. An example exercise device for a user in a wheelchair includes an automatically adjustable pick.

24 Claims, 19 Drawing Sheets

(56) References Cited

U.S. PATENT DOCUMENTS 5,277,685 A * 1/1994 Gonzales ..... A63B 71/0009 482/134
5,362,297 A * 11/1994 Muir ..... A63B 21/023 482/112
5,779,601 A * 7/1998 Ish, III ..... A63B 23/0494 482/100
6,447,430 B1 * 9/2002 Webb ..... A63B 21/154 482/93
6,447,433 B1 * 9/2002 Reyes ..... A63B 21/078 482/104
7,722,509 B2 * 5/2010 Eder ..... A63B 21/156 482/101
2002/0111254 A1 8/2002 O'Hearn
2009/0098986 A1 * 4/2009 Quinn ..... A63B 23/0355 482/100
2013/0296143 A1 * 11/2013 Staten ..... A63B 21/0618 482/98

* cited by examiner

EXERCISE DEVICE

CROSS-REFERENCE TO RELATED APPLICATIONS

This application claims priority to U.S. Provisional Application No. 61/855,066, which was filed on 7 May 2013 and is incorporated herein by reference.

BACKGROUND

The present disclosure relates generally to equipment for exercising. More particularly, this disclosure relates to a device that can be used by a mobility-impaired user, such as user of a wheelchair.

Various exercises have been utilized to develop and train various areas of the body. Exercises have historically been performed with resistance provided by free weights, such as barbells or machines, or even using a user's body as resistance.

Many exercise devices contain adjustment features allowing a user to adapt the exercise devices for a particular exercises. Many of the adjustment features are not accessible to users with impaired mobility. Further, many areas of the assembly will not accommodate devices, such as wheelchairs, frequently utilized by users with impaired mobility. Thus, a mobility-impaired user cannot effectively train on many exercise devices.

SUMMARY

An apparatus according to an exemplary aspect of the present disclosure includes, among other things, an exercise device providing an exercise area configured to receive a wheelchair, at least one primary handle moveable by a first user in the wheelchair from a first position to a second position, and a resistance assembly that opposes movement of the at least one primary handle. At least one spotter handle is coupled to move together with the at least one primary handle. The at least one spotter handle is accessible by a second user from a position outside the exercise area.

In another example of the foregoing apparatus, the primary handle comprises a first primary handle to be positioned on a first lateral side of the first user and a second primary handle to be positioned on an opposing, second lateral side of the first user. The spotter handle comprises a first spotter handle to be positioned on the first lateral side and a second spotter handle to be positioned on the second lateral side.

In another example of any of the foregoing apparatus, the apparatus further comprises a wheelchair guide to position the wheelchair within the exercise area.

In another example of any of the foregoing apparatus, the apparatus further comprises a link coupling movement of the at least one primary handle together with movement of the at least one spotter handle. The wheelchair guide is positioned between the link and the exercise area.

In another example of any of the foregoing apparatus, the apparatus further comprises a second exercise area that is separate and distinct from the first exercise area, and a pick accessible from the second exercise area. Exercises using the pick are resisted with the resistance assembly.

In another example of any of the foregoing apparatus, the resistance assembly comprises a weight stack.

In another example of any of the foregoing apparatus, the apparatus further comprises a lap pad configured to stabilize a user between the lap pad and the wheelchair when the user is utilizing the pick.

In another example of any of the foregoing apparatus, the lap pad is pivotable back and forth between a first position where the lap pad extends substantially vertically and a second position where the lap pad extends substantially horizontally.

An exercise device for a user in a wheelchair according to another exemplary aspect of the present disclosure includes, among other things, an automatically adjustable pick.

In another example of the foregoing exercise device, a belt is secured to the pick. The belt is configured to be driven to move the pick.

In another example of any of the foregoing exercise devices, the belt is looped such that opposing ends of the belt are secured to the pick.

In another example of any of the foregoing exercise devices, the belt is clamped to the pick.

In another example of any of the foregoing exercise devices, the belt is a toothed belt.

In another example of any of the foregoing exercise devices, the device comprises a sprocket to drive the belt to move the pick.

In another example of any of the foregoing exercise devices, the pick is configured to adjust between a first position that is vertically above a head of a user during use, and a second position that is vertically below a knee of the user during use.

In another example of any of the foregoing exercise devices, the pick is configured to be infinitely adjustable between the first position and the second position.

In another example of any of the foregoing exercise devices, a lap pad is configured to stabilize a user between the lap pad and a wheelchair.

In another example of any of the foregoing exercise devices, the lap pad is pivotable back and forth between a first position where the lap pad extends substantially vertically and a second position where the lap pad extends substantially horizontally.

In another example of any of the foregoing exercise devices, the lap pad is pivotable about a pivot location on a first side of the user to a selectively engage a support on a second side of the user that is opposite the first side.

An exercise device for a user in a wheelchair according to yet another exemplary aspect of the present disclosure includes, among other things, a pivotable lap pad configured to stabilize a user between the lap pad and a wheelchair.

In another example of the foregoing exercise device, the lap pad is pivotable back and forth between a first position where the lap pad extends substantially vertically and a second position where the lap pad extends substantially horizontally.

In another example of any of the foregoing exercise devices, the lap pad is pivotable about a pivot location on a first side of the user to a selectively engage a support on a second side of the user that is opposite the first side.

A method of exercising when positioned within a wheelchair includes, among other things, positioning a user and the wheelchair within an exercise area of an exercise device, and moving a primary handle of an exercise device. The moving of the primary handle is resisted by a resistance device. The method includes moving a spotter handle to assist the moving of the primary handle. The spotter handle is coupled in movement together with the primary handle.

In another example of the foregoing method, the moving of the primary handle is a pivoting movement around a first axis, and the moving of the spotter handle is a pivoting movement around a second axis spaced from the first axis.

In another example of the any of the foregoing methods, the method comprises moving to another exercise area and automatically adjusting a height of a pick.

In another example of the any of the foregoing methods, the method comprises pivoting a lap pad from a first position where the lap pad extends substantially vertically and a second position where the lap pad extends substantially horizontally, stabilizing the user between the lap pad and a wheelchair, and exercising using the pick.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The various features and advantages of the disclosed examples will become apparent to those skilled in the art from the detailed description. The figures that accompany the detailed description can be briefly described as follows.

DETAILED DESCRIPTION

Figure 1:
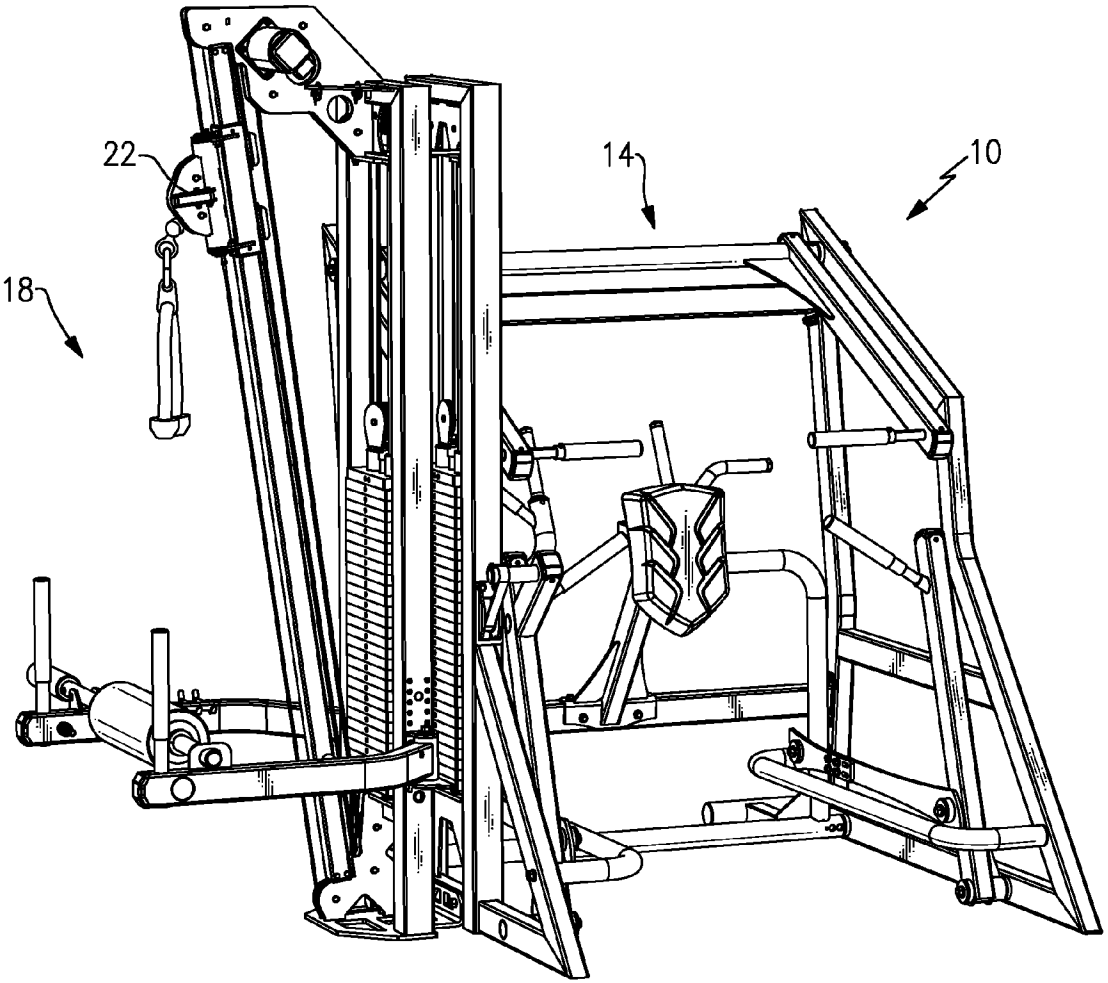
FIG. 1 shows a perspective view of an example wheelchair accessible exercise device.
Figure 2:
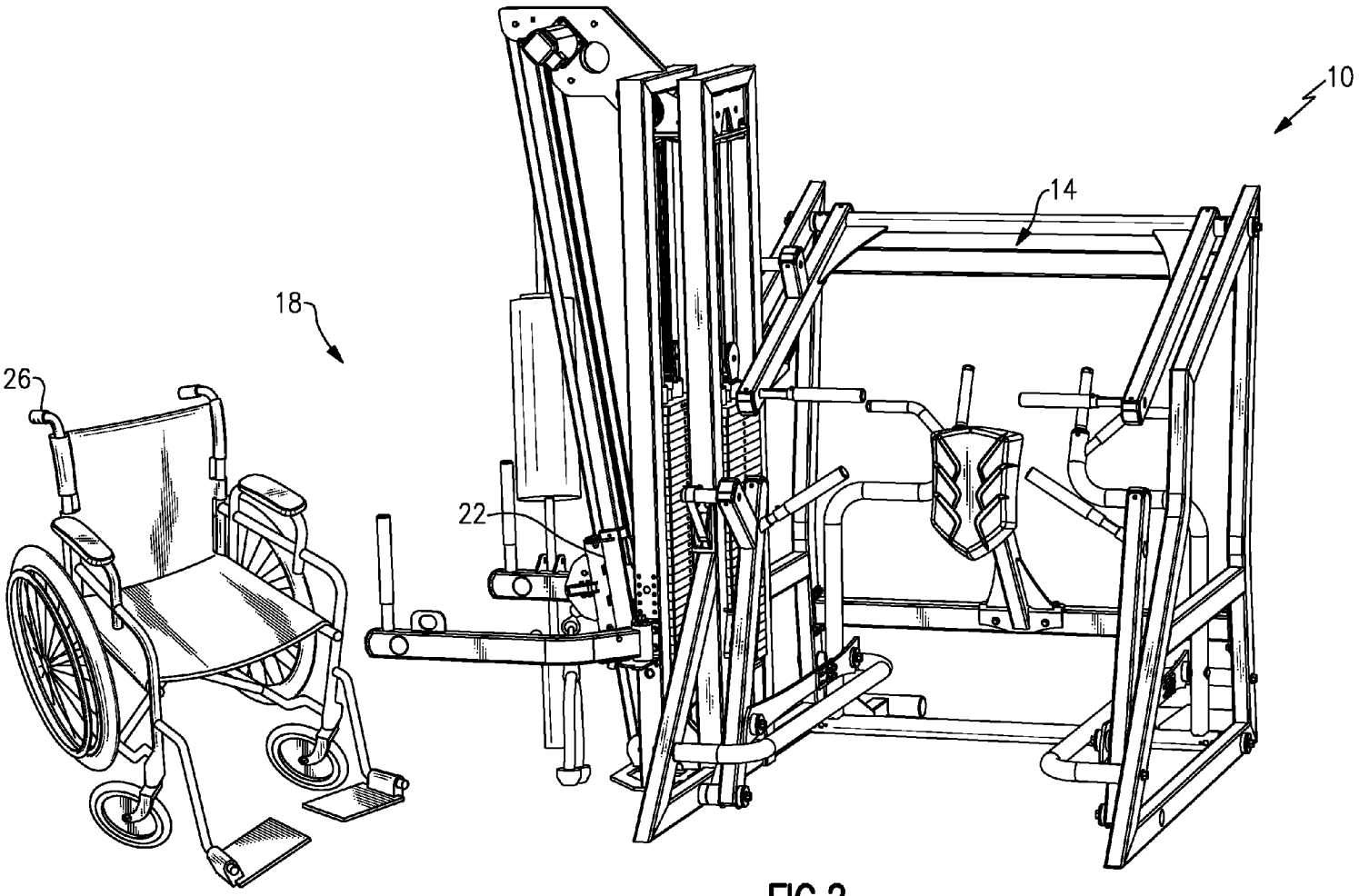
FIG. 2 shows another perspective view of the FIG. 1 device.

Referring to FIGS. 1 and 2, an example exercise device 10 includes, generally, a first exercise area 14 and a second exercise area 18. The first exercise area 14 is used for exercises, such as rows, chest presses, overhead presses, etc. The second exercise area 18 is used for exercises that involve an adjustable pick 22, such as cable-based pulls, curls, etc. Notably, the user may remain seated in a wheelchair 26 when performing exercises within the first exercise area 14 and the second exercise area 18.

Exercise, in this disclosure, encompasses training, therapy, drills, calisthenics, and other pursuits requiring physical effort.

Figure 3:
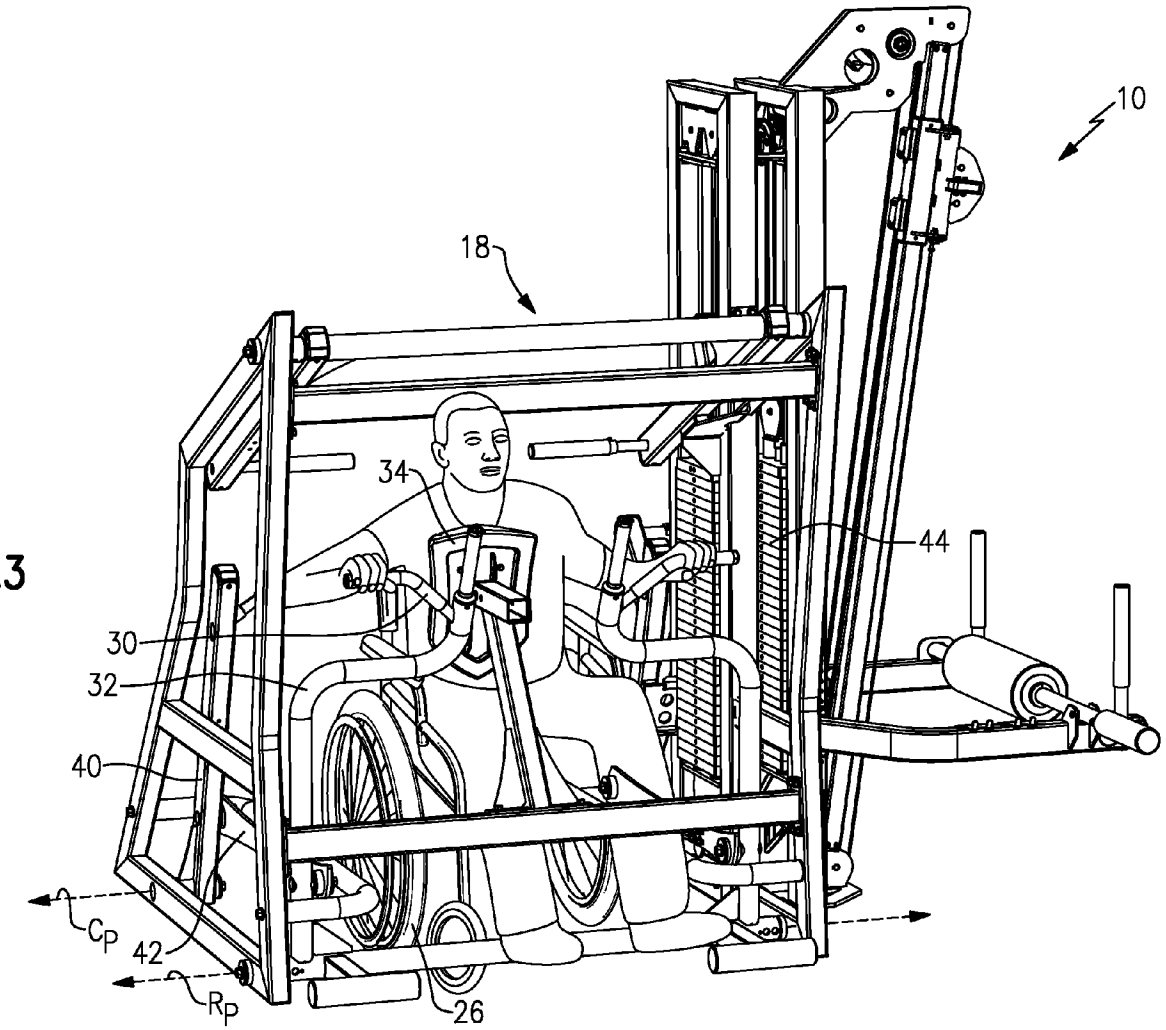
FIG. 3 shows a user utilizing a row exercise portion of the device of FIG. 1.
Figure 4:
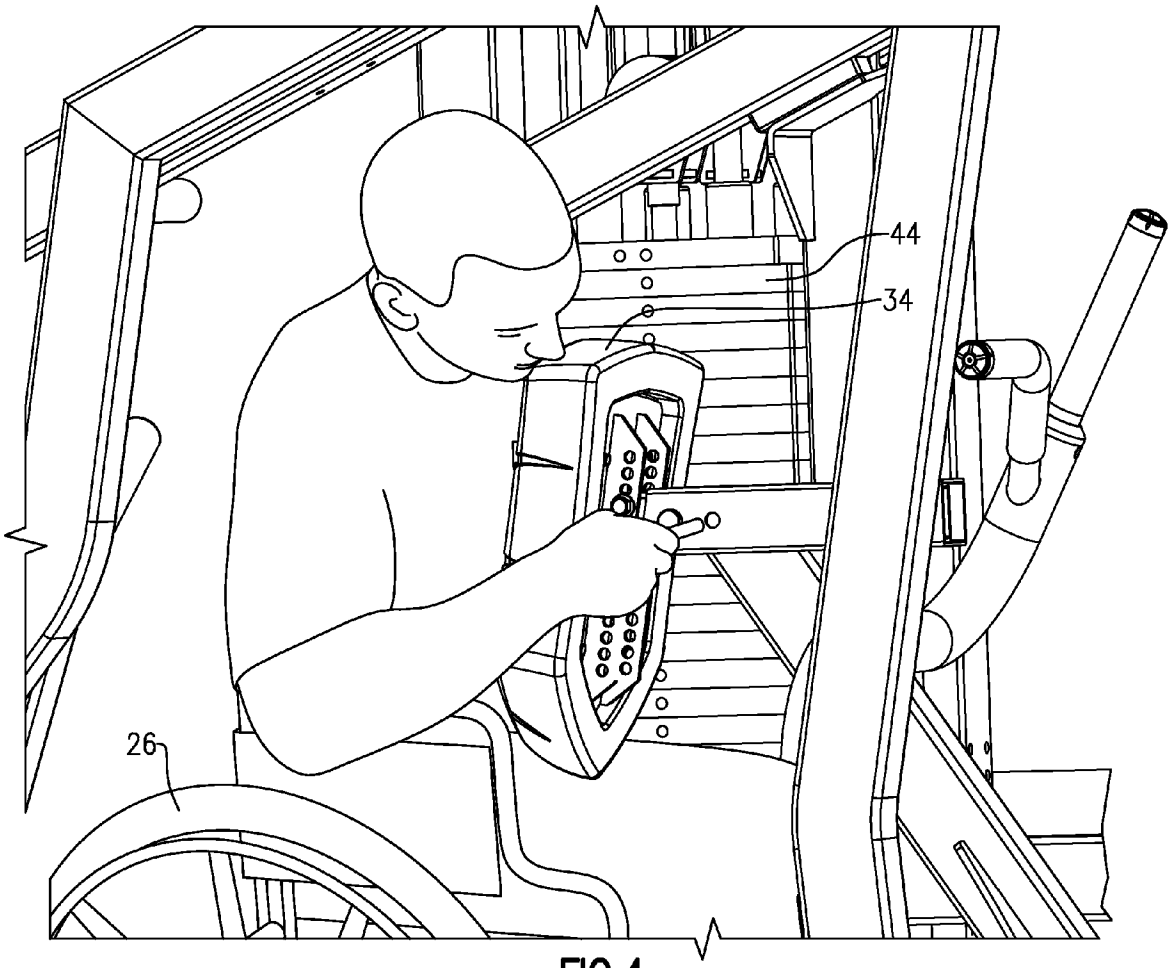
FIG. 4 shows the user making an adjustment to the device of FIG. 1.
Figure 5:
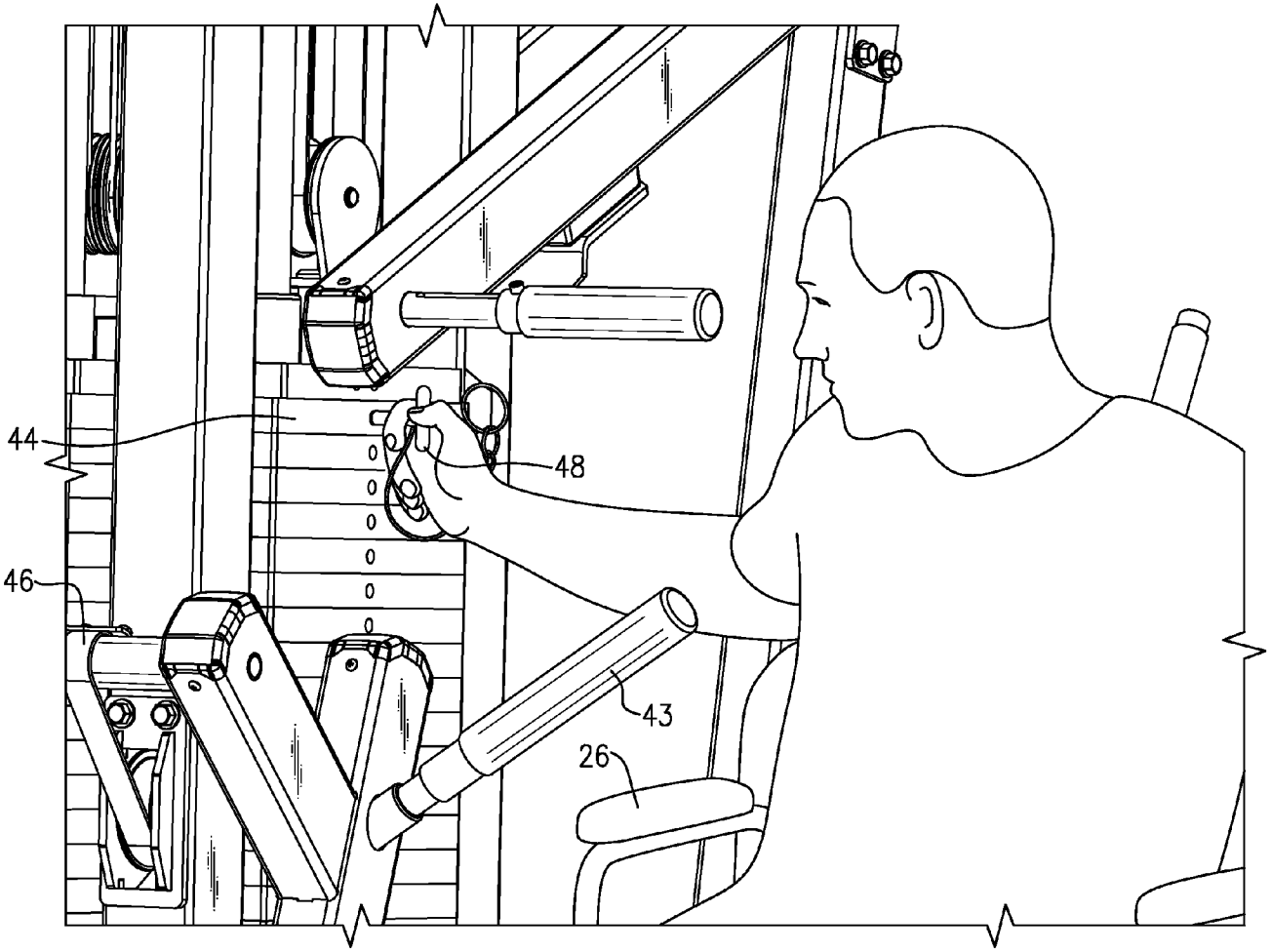
FIG. 5 shows the user making another adjustment to the device of FIG. 1.
Figure 6:
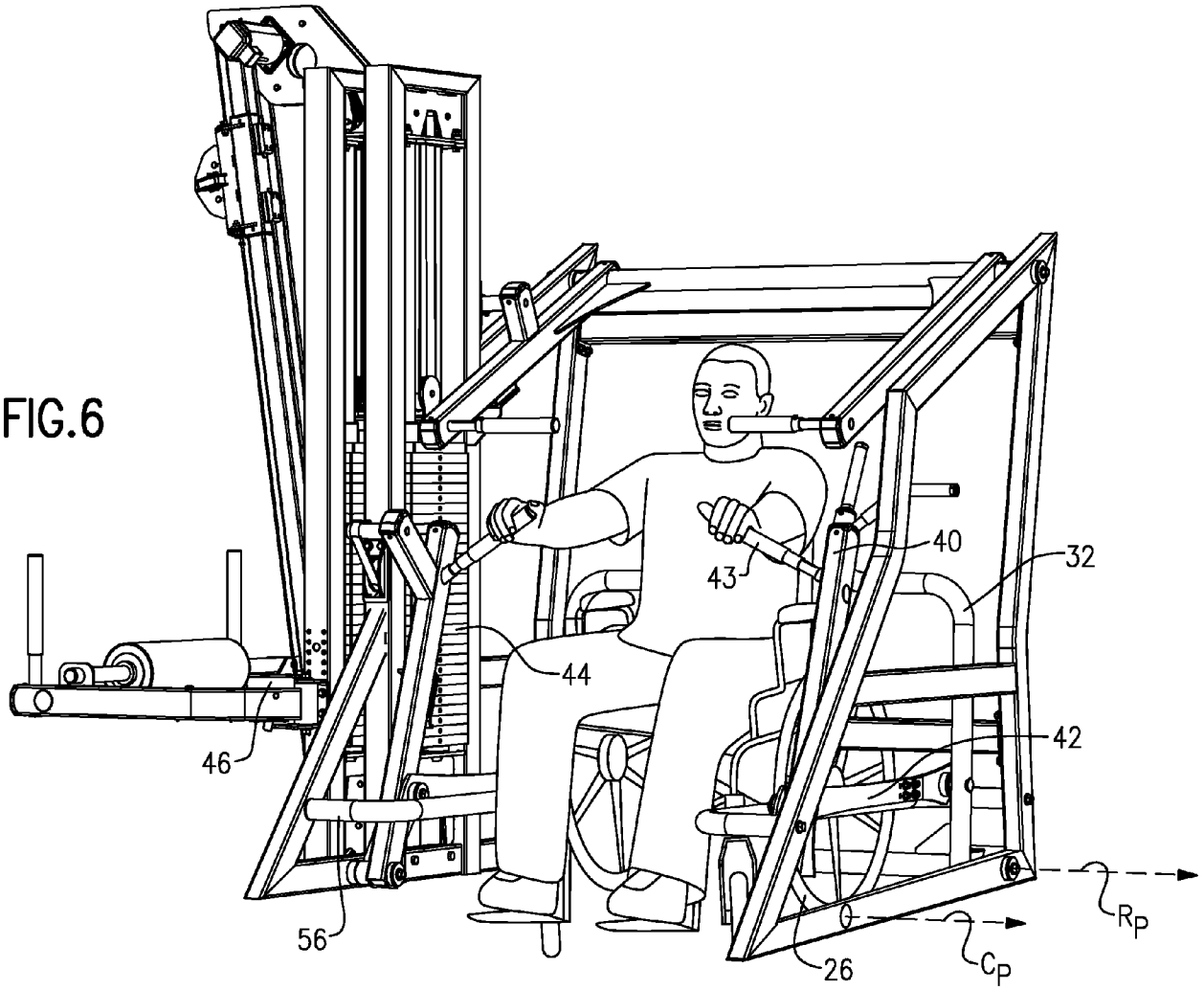
FIG. 6 shows the user utilizing a forward press portion of the device of FIG. 1.

Referring now to FIGS. 3 to 5, during a row exercise, the user grasps rowing handles 30 extending from row bars 32. To start a row, a chest of a user presses against a pad 34 as the user is seated in the wheelchair 26. The user then presses the rowing handles 30 away from their chest, which pivots the row bars 32 about a rowing pivot $R_p$. The rowing handles 30 are user handles in this example since the exercising user grasps these handles when exercising.

The row bars 32 are coupled to chest press bars 40 via a linking member 42. The chest press bars 40 are attached to a weight stack 44 via a belt 46. When the user pivots the row bars 32 about the pivot $R_p$, the linking member 42 pulls the chest press bars 40 causing the chest press bars 40 to pivot about a chest press pivot $C_p$. The weight stack 44 provides resistance to the rowing exercise through the belt 46, the chest press bars 40, the linking member 42, and the row bars 32.

Notably, a trainer (not shown) may press and pull on the chest press bars 40 to assist or "spot" the user during the rowing exercise as needed. This assistance can be provided in an area clear from the wheelchair 26 and outside the exercise area 18. When used for spotting, the chest press bars 40 are considered spotter handles.

The user may adjust the position of the pad 34 via a pin and socket type attachment to place the rowing handles 30 at a desired location relative to the user when the user's chest is pressed against the pad 34.

Referring to FIGS. 5 to 8 with continuing reference to FIGS. 3 and 4, during a forward press exercise, the user in the wheelchair may position their back (or a back of the wheelchair 26) against the pad 34. The user in the wheelchair may then adjust resistance of the press by increasing or decreasing the resistance by moving a pin 48 within the weight stack 44 to cause more or less weight to be during the press.

When performing the chest press, the user grasps chest press handles 43 extending from the chest press bars 40. The pivoting movement of the chest press bars 40 as the user pushes the chest press handles 43 forward pulls the row bars 32 forward via the linking member 42. Forward movement of the chest press handles 43 and chest press bars 40 is resisted by the weight stack 44, which, again, is coupled to the chest press bar 40 via the belt 46. The trainer may manipulate the position of the rowing handles 30 to assist the user when performing the chest press. During this exercise, the chest press handles 43 act as user handles, and the rowing handles 30 act a spotter handles.

Figure 7:
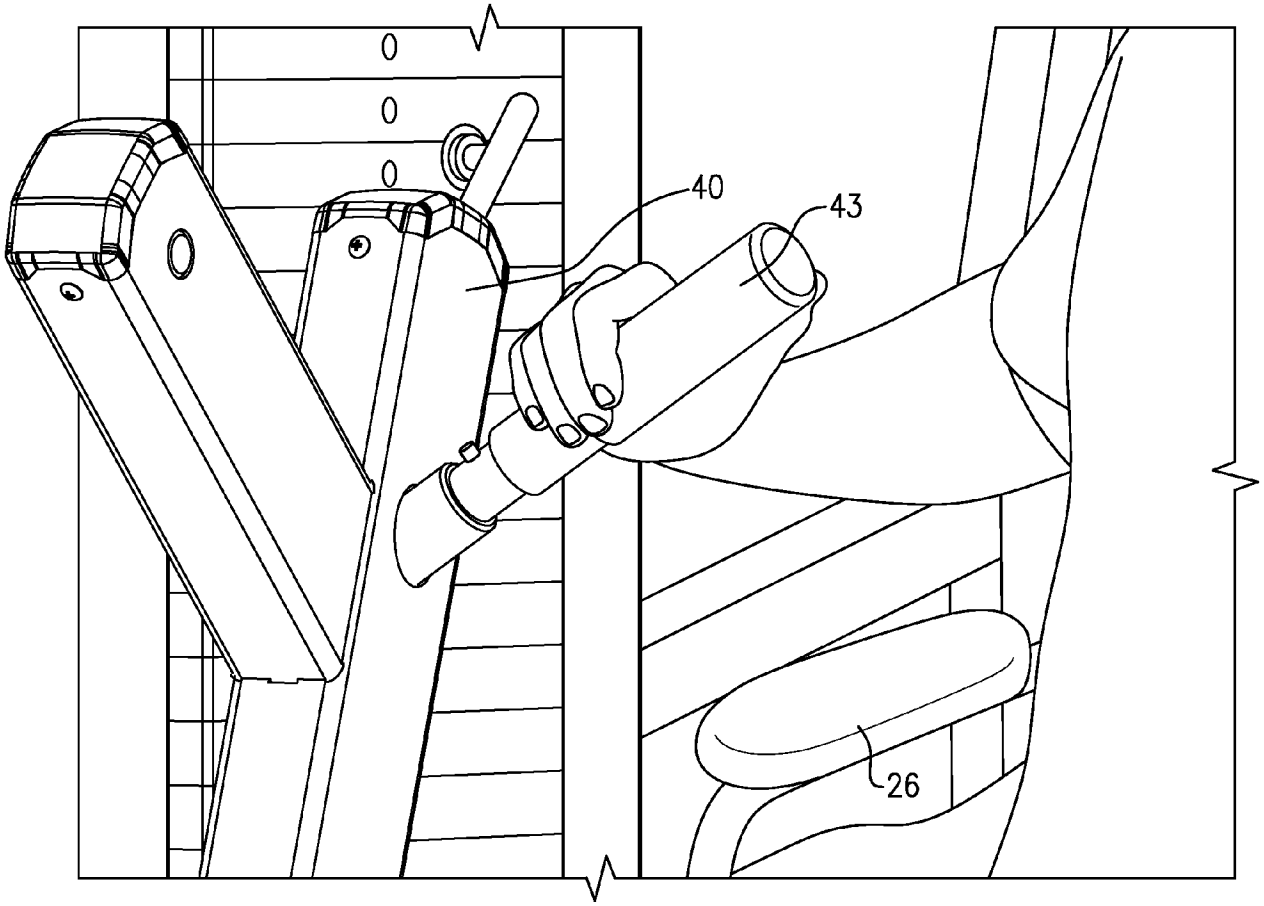
FIG. 7 shows a handle of the forward press portion of FIG. 6 in a first position.
Figure 8:
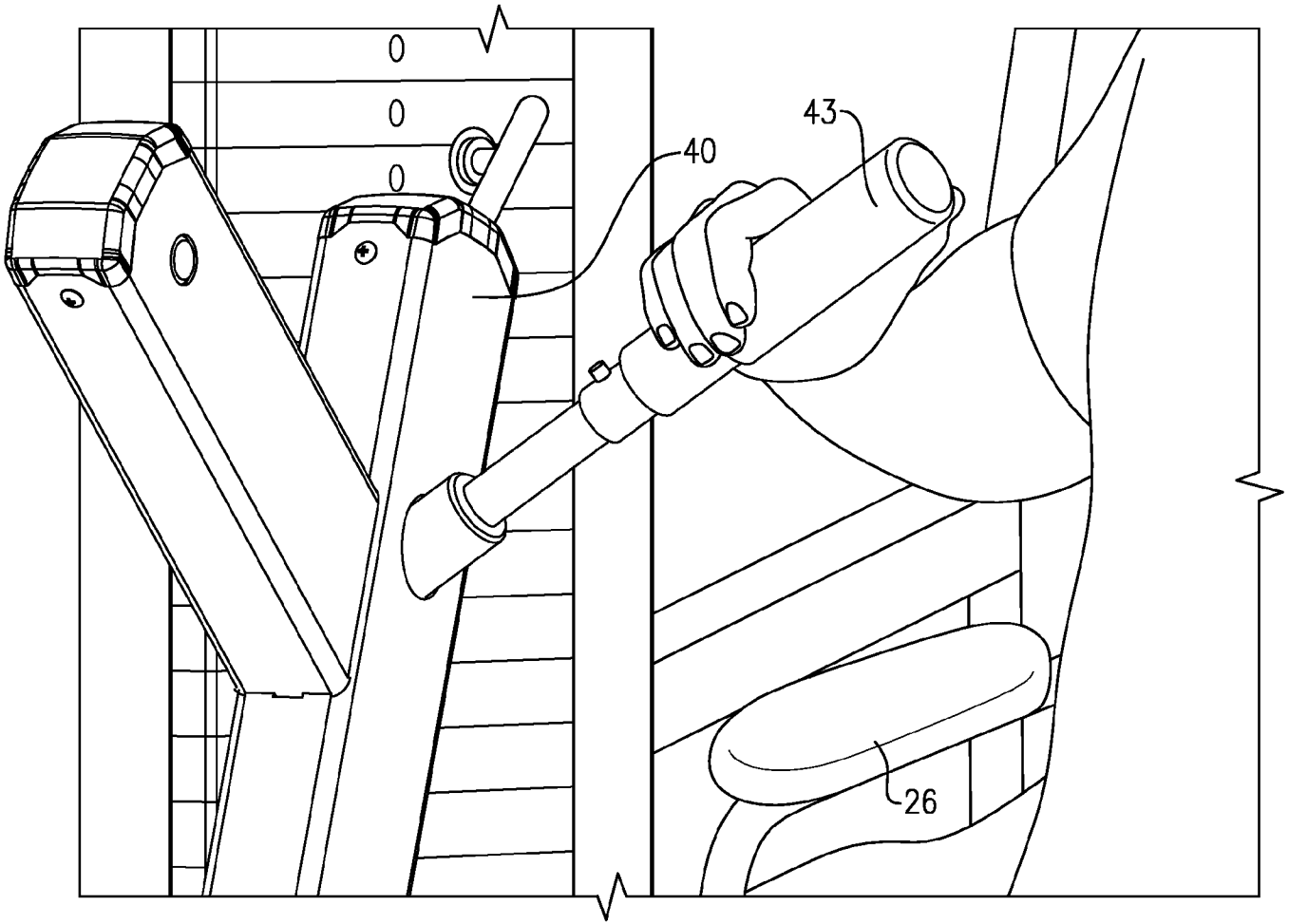
FIG. 8 shows the handle of FIG. 7 in a second position.

The chest press handles 43 are moveable between the retracted position of FIG. 7 and the extended position of FIG. 8. Other handles of the device 10 may be similarly moveable.

Figure 9:
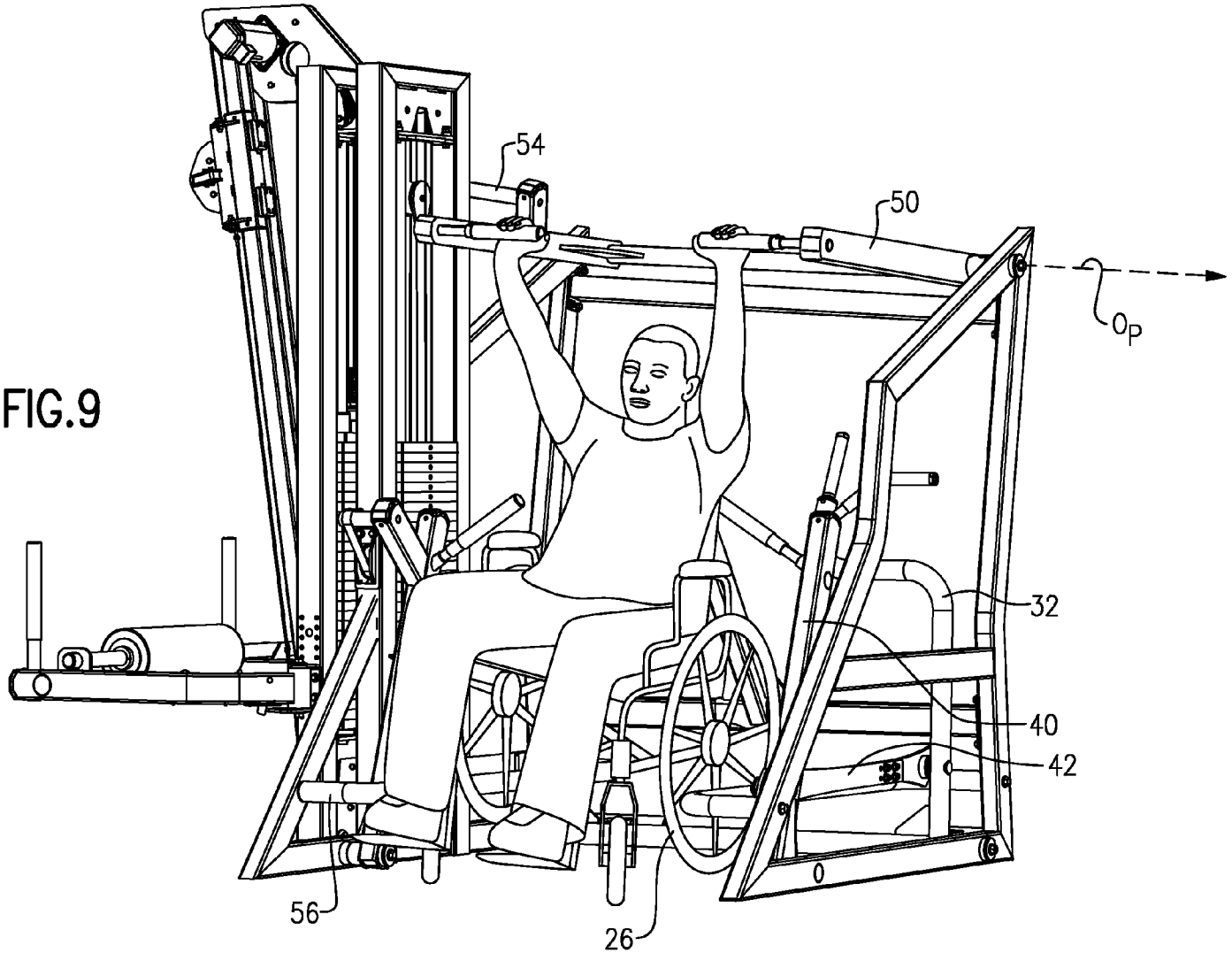
FIG. 9 shows the user utilizing an overhead press portion of the device of FIG. 1.
Figure 10:
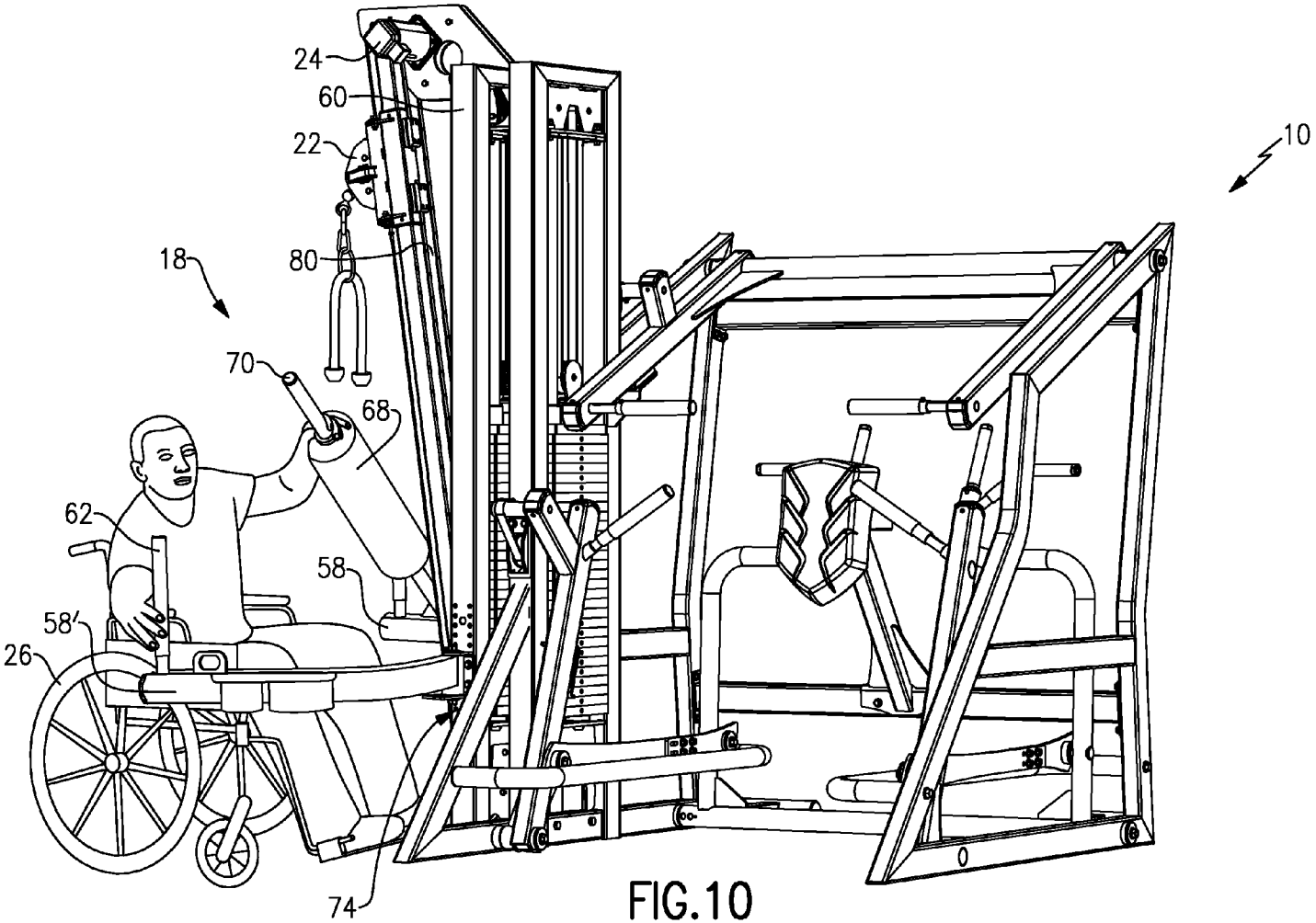
FIG. 10 shows the user positioning a lap pad of the device of FIG. 1.
Figure 11:
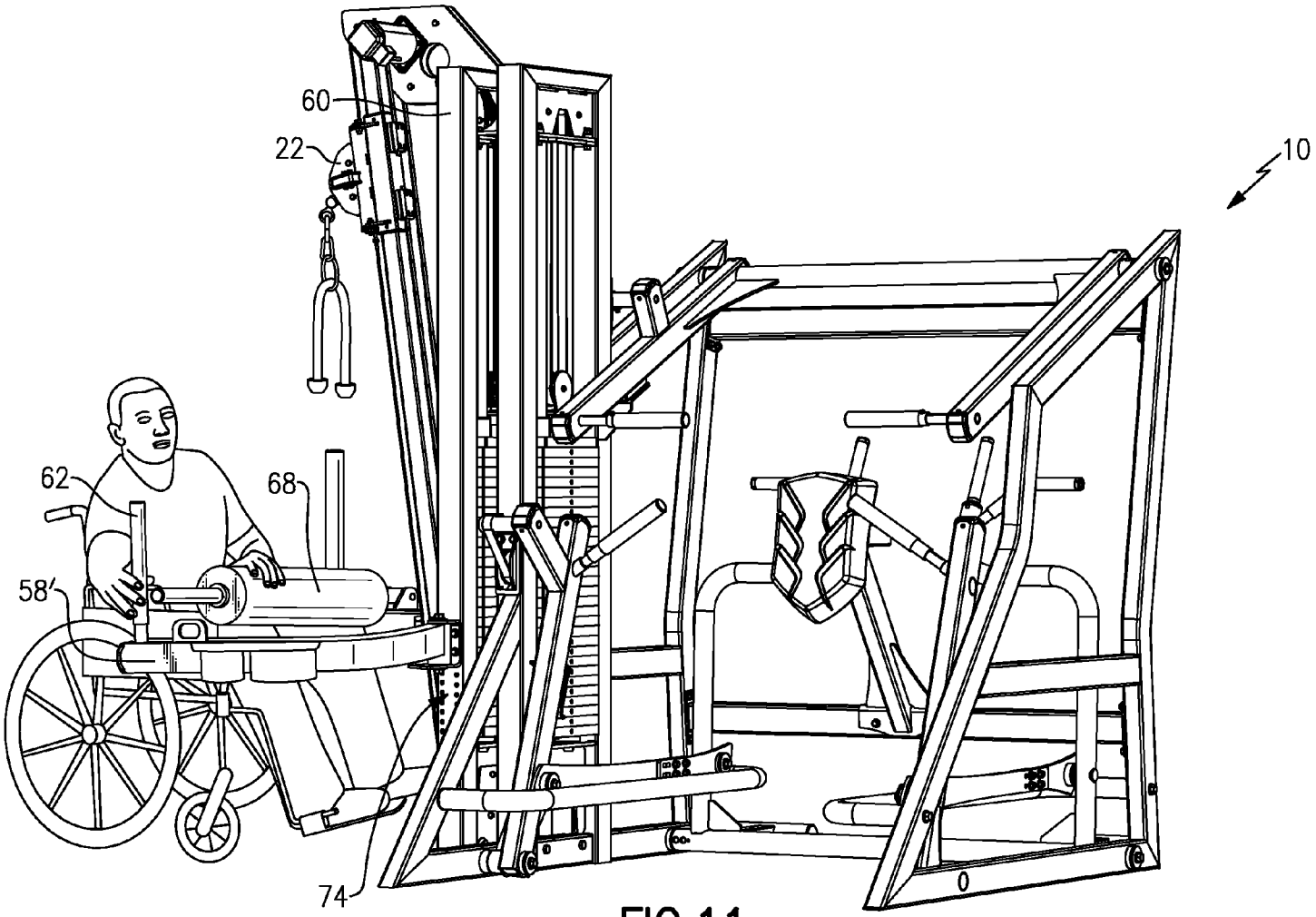
FIG. 11 shows the user positioning a lap pad support arm of the device of FIG. 1.
Figure 12:
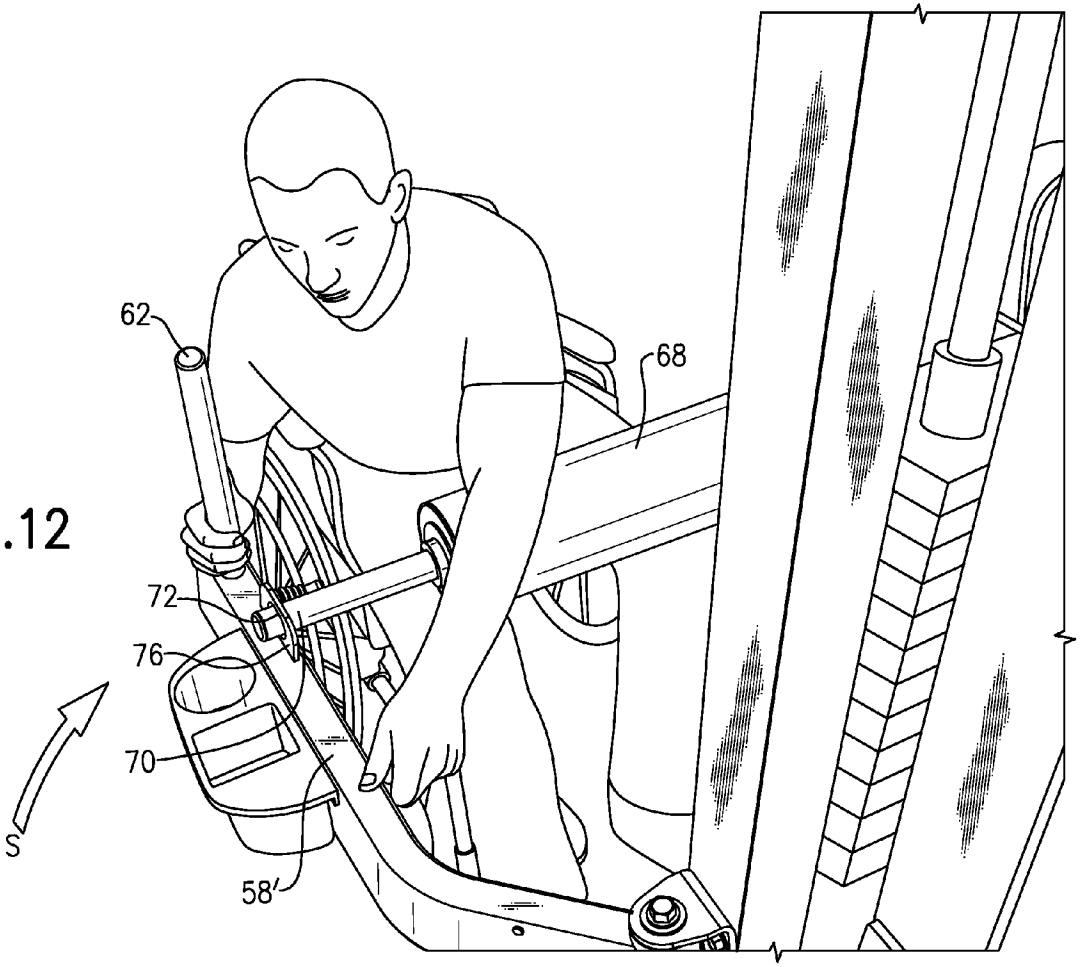
FIG. 12 shows the user engaging the lap pad with the lap pad support arm.
Figure 13:
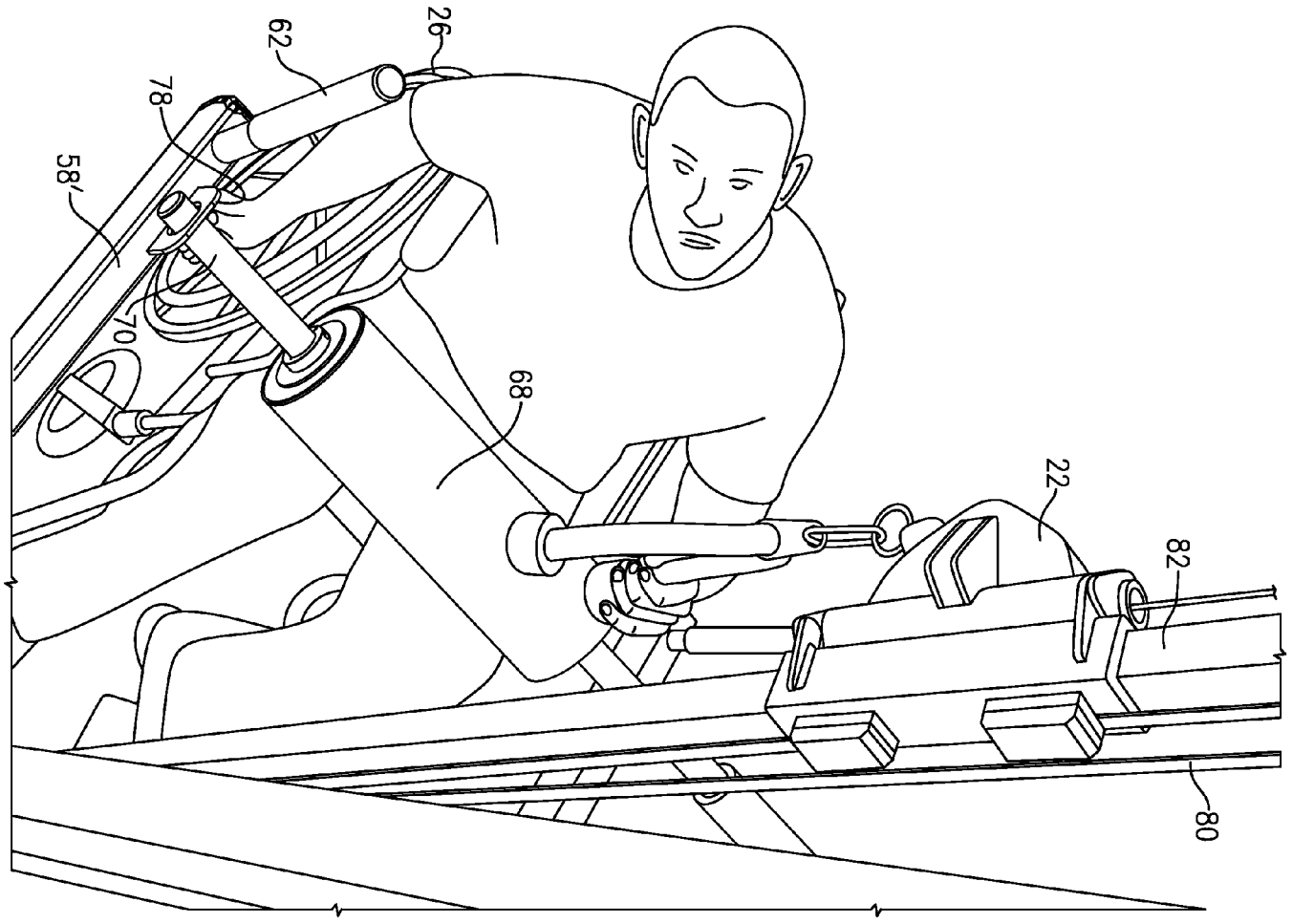
FIG. 13 shows the user automatically adjusting a pick location of the device of FIG. 1.
Figure 14:
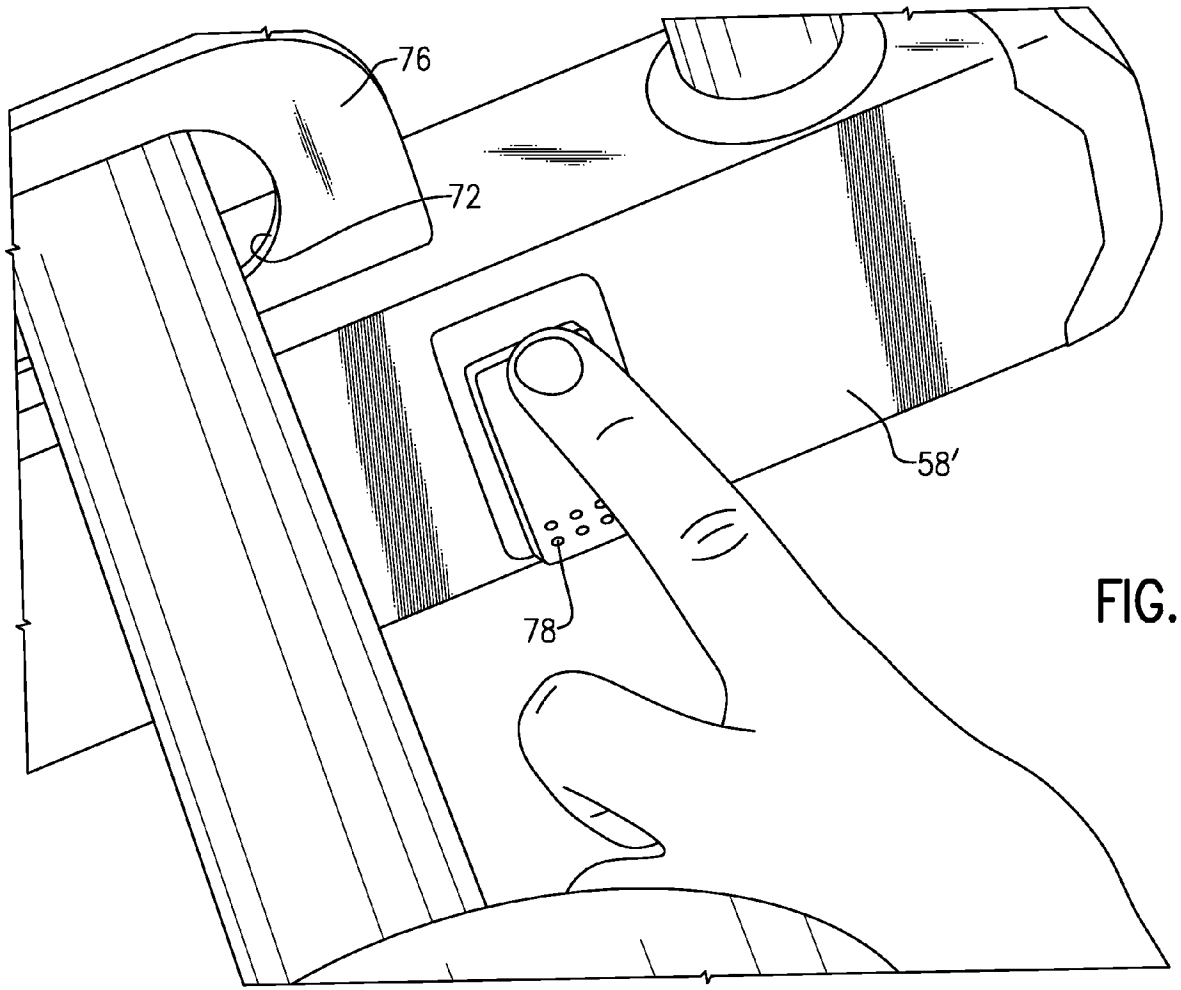
FIG. 14 shows a button on the lap pad support arm utilized to adjust the pick position.
Figure 15:
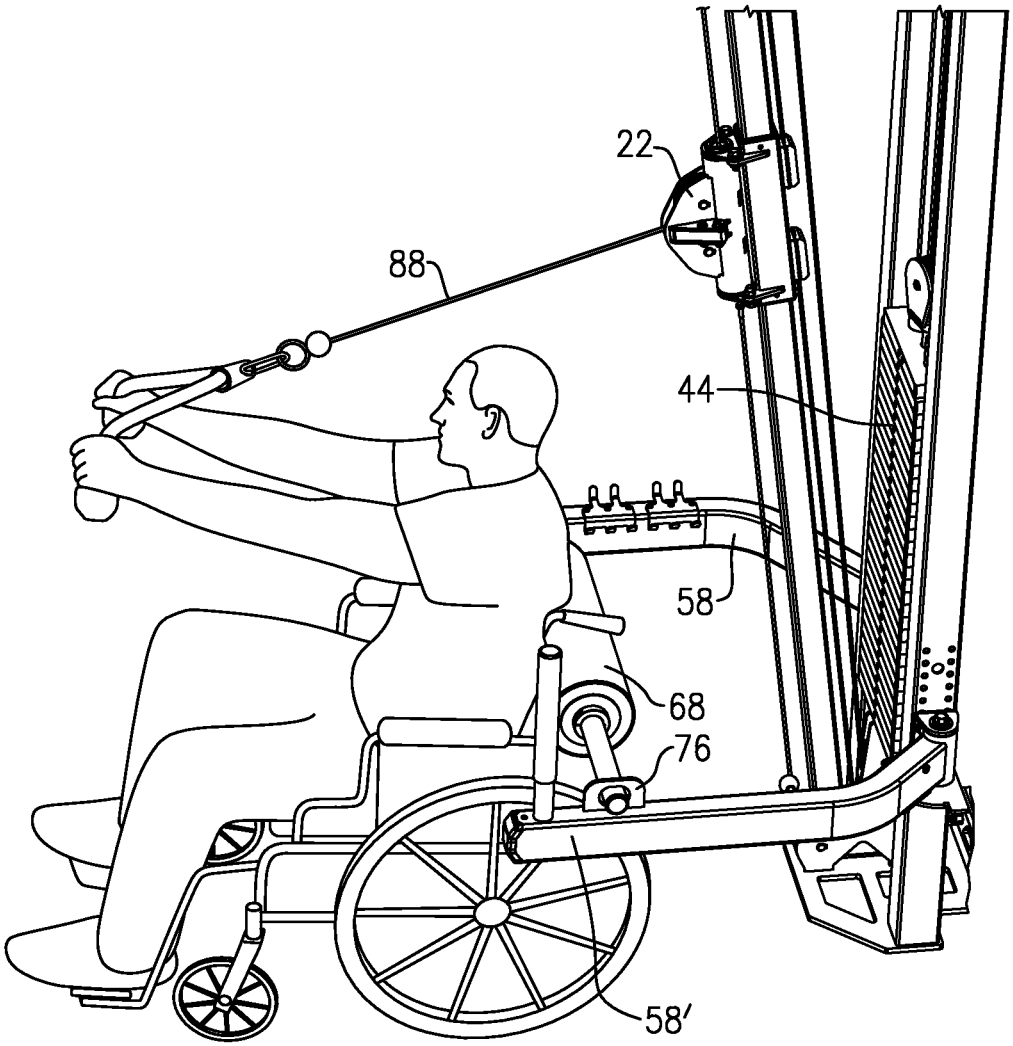
FIG. 15 shows the user performing an overhead cable pull.

Referring to FIG. 9, an additional exercise performed by the user within the first exercise area 14 is an overhead press. During such an exercise, the user pivots overhead press bars 50 about an overhead press axis $O_p$ by repositioning overhead press handles 52. Rotation of the overhead press bars 50 is resisted by the weight stack 44, which is coupled to the overhead press bars via a belt 54.

The first exercise area 14 may include guides 56 to help position the user, and the user's wheelchair, within the first exercise area 14. The guides 56 also prevent the wheelchair 26 from interfering with the moveable linking member 42 and other moveable structures. Many exercises are possible within the first exercise area 14. These exercises are accessible to the user confined to a wheelchair.

Referring now to FIGS. 10 to 18, the wheelchair accessible exercise device 10 provides further exercises within the second exercise area 18. The second exercise area 18 includes a pair of supports 58, 58' extending generally horizontally from a tower 60 of the device 10. The supports 58, 58' define an open area therebetween, which can receive the wheelchair 26.

One of the supports 58' is hingably secured to the tower 60. The user may pivot the support 58' by moving the handles 62. The user may pivot the support 58' when entering or leaving the second exercise area 18. In other examples, both supports 58, 58' may pivot relative to the tower 60.

Handles 62 extend vertically upward from the supports 58, 58'. A lap pad 68 is hingably connected to the supports 58. The lap pad 68 can be rotated to lift the lap pad 68 vertically. This allows user to enter the second exercise area 18. When the wheelchair 26 and user are properly positioned within the second exercise area 18, the user rotates the lap pad 68 from the position in FIG. 10 to the position in FIG. 11, where the lap pad 68 rests on a lap of the user (or knees) of the user in the wheelchair 26.

The user then rotates the support 58 in a direction S (FIG. 12) such that a bar 70 of the lap pad 68 is received within an aperture 72 defined within a plate 76 of the support 58'. The plate 76 limits movement of the lap pad 68 so that the lap pad 68 provides a suitable support during exercises within the second exercise area 18. Notably, no support structure extends between the user's legs, such structure could potentially interfere with the wheelchair 26 entering the second exercise area 18.

If a vertical height adjustment of the lap pad 68 is required, the supports 58, 58' may be adjusted between one of several positions on the tower 60 by selectively engaging with one of several apertures 74.

Figure 20:
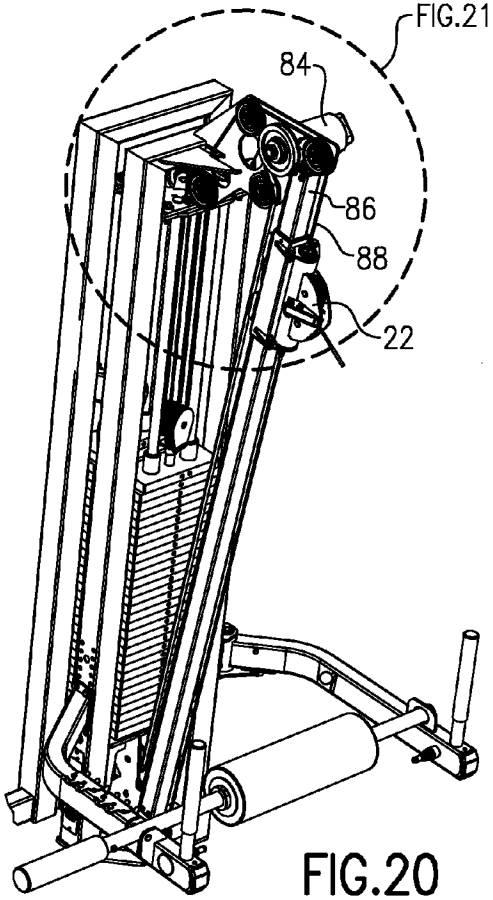
FIG. 20 shows a perspective view of an adjustable pick and rail of the device of FIG. 1.
Figure 21:
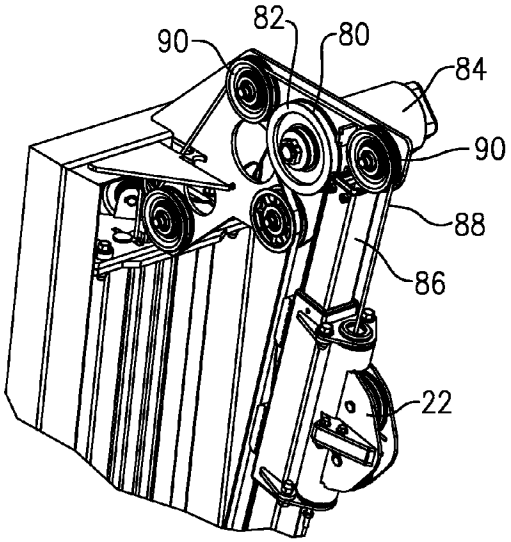
FIG. 21 shows a perspective view of an adjustable pick and rail of the device of FIG. 1.
Figure 19:
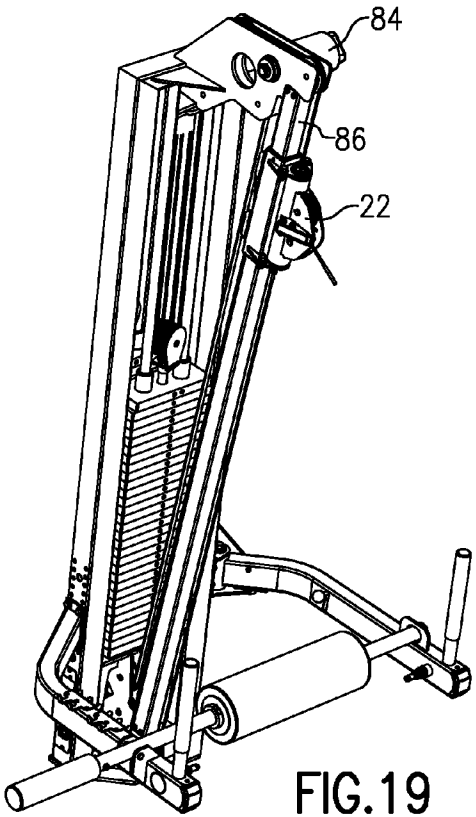
FIG. 19 shows a perspective view of an adjustable pick and rail of the device of FIG. 1.

After the user has appropriately positioned themselves within the second exercise area 18, the user may adjust a location of the adjustable pick 22. In this example, the user presses one of two buttons 78 positioned on each of the supports 58, 58' to adjust the vertical height of the adjustable pick 22. Actuating the button 78 causes a motor 84 to rotate and move a belt 80 (see FIGS. 19 to 21). Opposing ends of the belt 80 are attached to the adjustable pick 22. Rotating the belt 80 causes the adjustable pick 22 to move vertically up and down along a track or rail 86.

Figure 16:
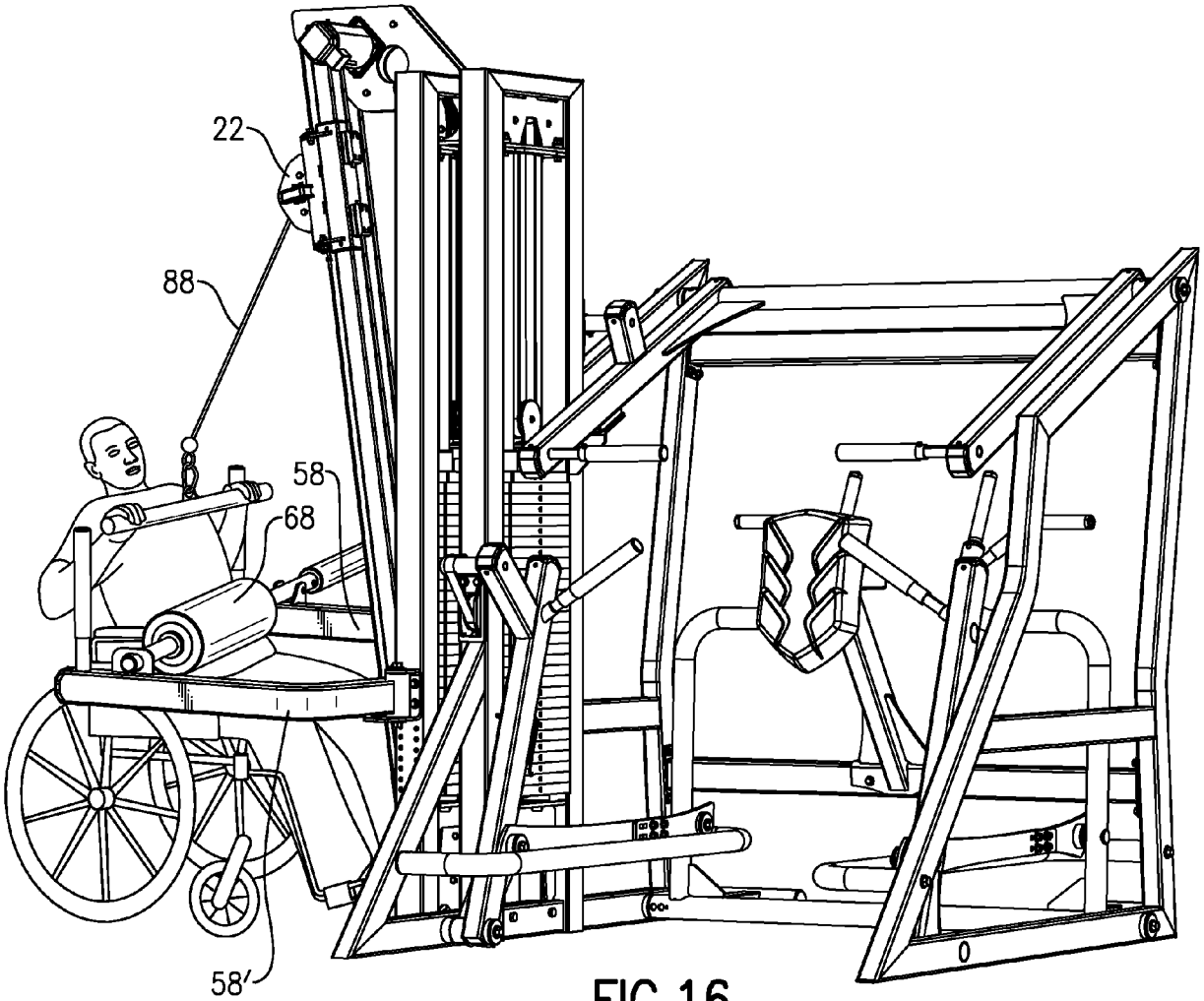
FIG. 16 shows the user performing a chest cable pull.

The adjustable pick 22 is effectively infinitely adjustable between a lowest position that is, in this example, below the knees of the user (see FIG. 17) to a vertically highest position that is well above a head of the user (see FIG. 16). Notably, the user is not required to stand or get out of the wheelchair 26 when adjusting the adjustable pick 22 to a desired position, even if that position is well above the head of the user.

As can be appreciated, various exercises may be performed using a cable 88 that is attached to the weight stack 44. Example exercises include the overhead rope pull shown in FIG. 15 and the chest pull shown in FIG. 16. During the overhead rope pull of FIG. 15, a back of the wheelchair 26 may be positioned against the lap pad 68 to stabilize the user.

Figure 17:
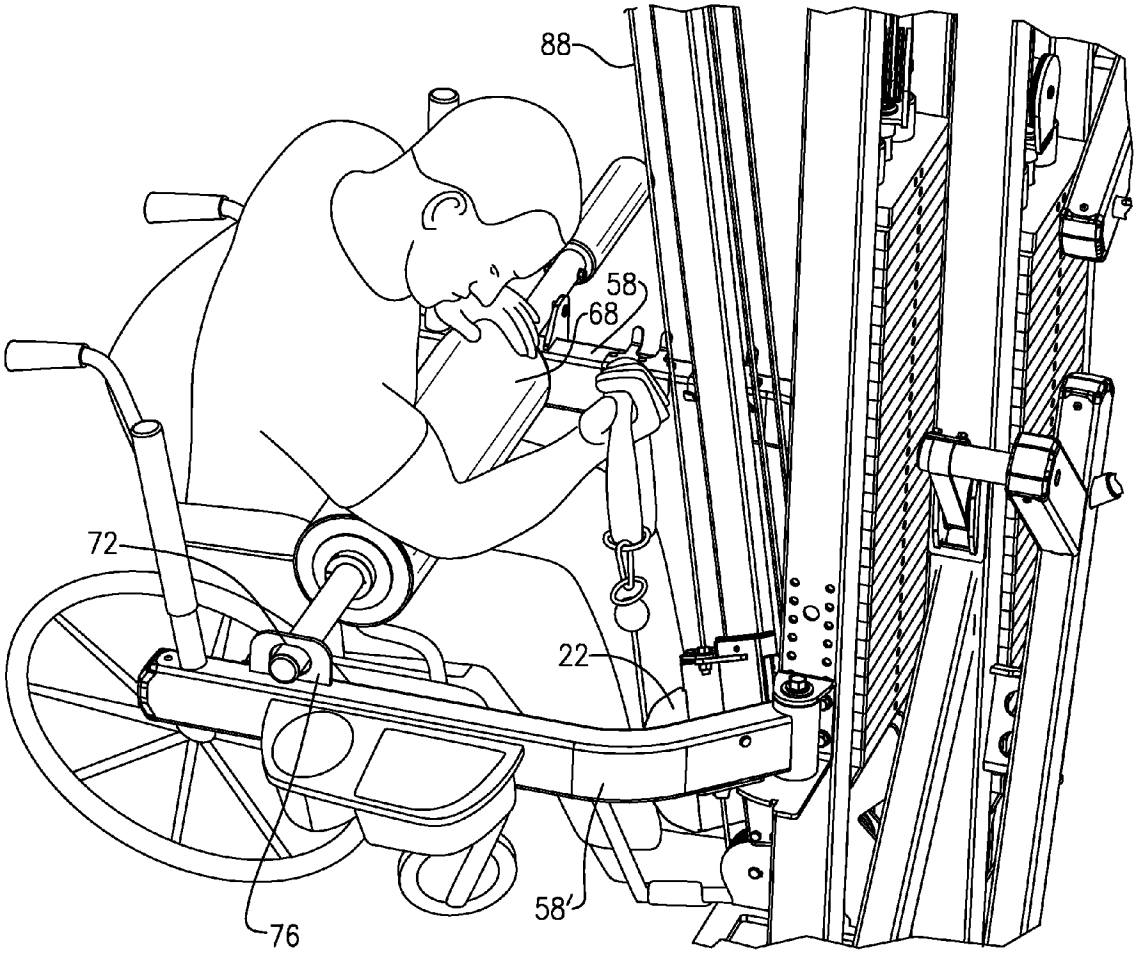
FIG. 17 shows the user performing a bicep curl with the lap pad in an engaged position.
Figure 18:
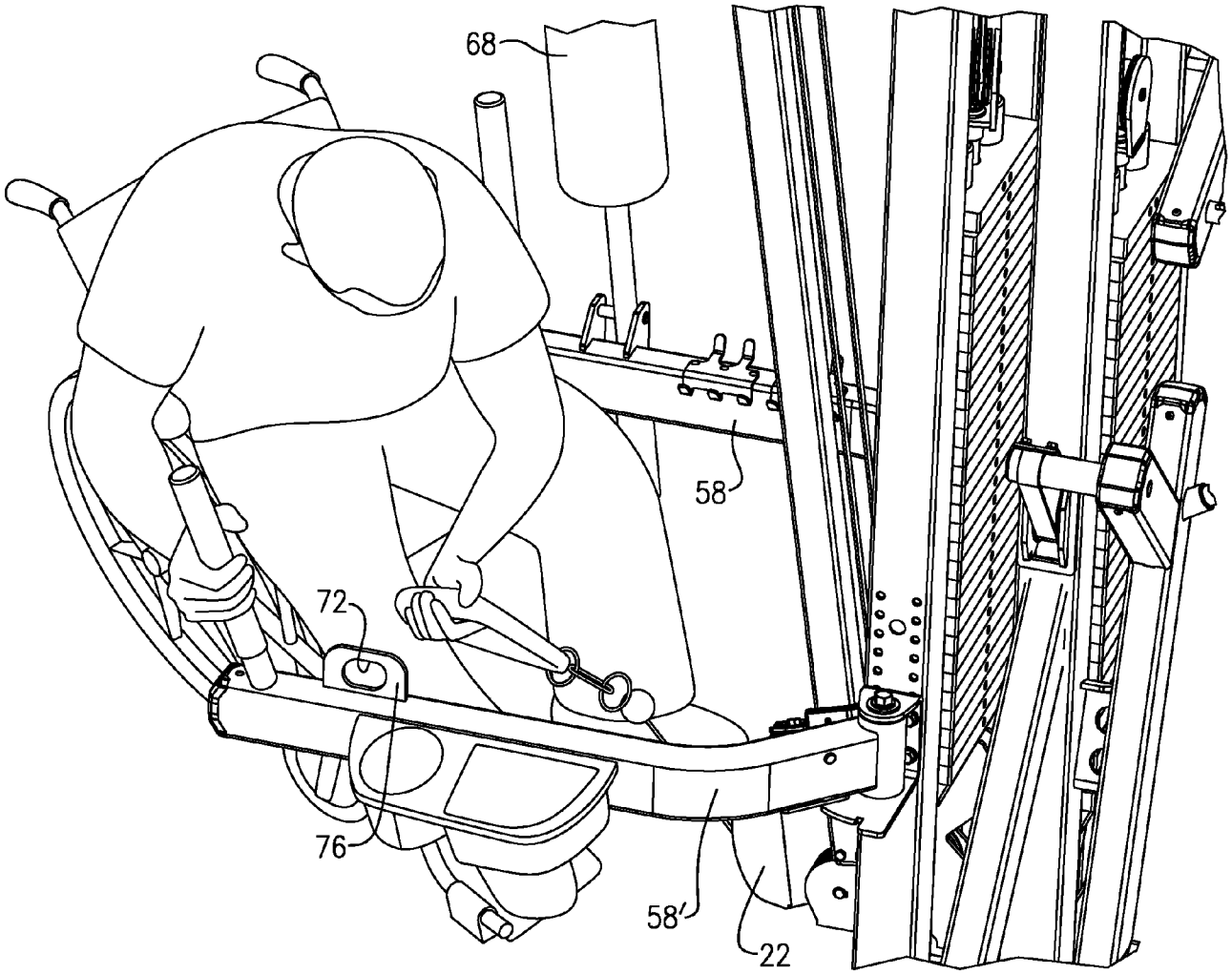
FIG. 18 shows the user performing a bicep curl with the lap pad in a disengaged position.

Other example exercises include the bicep curl shown in FIG. 17 and the bicep curl shown in FIG. 18. The bicep curl of FIG. 18 does not require the lap pad 68 to be engaged within the plate 76 of the handles 62. Other exercise may not require the lap pad 68 to be engaged with the plate 76.

The adjustable pick 22 rides along the rail 86 when moved by the motor 84 and the adjustment belt 80. The example belt 80 is a toothed belt, which helps avoid slippage of the motor 84 on the rail 86. The motor 84 turns a sprocket 82 to drive the belt 80. The cable 88 loops over the top of the belt 80 through two horizontally spaced guide pulleys 90.

Features of the disclosed examples include an automatically, infinitely adjustable pick point location. Also, two primary belts and a single weight stack are used for effectively three machines—a row, chest press, and overhead press. The adjustable pick exercises are also off of the same weight stack.

A single user, such as a user seated within a wheelchair, can complete an effective workout, including making desired adjustments to weights and positions, without requiring a spotter or training partner.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

The invention claimed is:

1. An apparatus for a user in a wheelchair, comprising:

an exercise device providing an exercise area configured to receive a wheelchair;

at least one primary handle moveable by a first user in the wheelchair from a first position to a second position;

a resistance assembly that opposes movement of the at least one primary handle;

at least one spotter handle coupled to move together with the at least one primary handle, the at least one spotter handle accessible by a second user from a position outside the exercise area;

an adjustable support member; and a belt secured to the adjustable support member, the belt configured to be driven to move the adjustable support member, the belt looped such that opposing ends of the belt are secured to the adjustable support member.

2. The apparatus of claim 1, wherein the at least one primary handle comprises a first primary handle to be positioned on a first lateral side of the first user and a second primary handle to be positioned on an opposing, second lateral side of the first user, wherein the at least one spotter handle comprises a first spotter handle to be positioned on the first lateral side and a second spotter handle to be positioned on the second lateral side.

3. The apparatus of claim 1, further comprising at least one wheelchair guide to position the wheelchair within the exercise area.

4. The apparatus of claim 3, including a link coupling movement of the at least one primary handle together with movement of the at least one spotter handle, the at least one wheelchair guide positioned between the link and the exercise area.

5. The apparatus of claim 1, wherein the exercise area is a first exercise area, and further comprising a second exercise area that is separate and distinct from the first exercise area, and the adjustable support member is accessible from the second exercise area, wherein exercises using the adjustable support member are resisted with the resistance assembly.

6. The apparatus of claim 5, wherein the resistance assembly comprises a weight stack.

7. The apparatus of claim 5, further comprising a lap pad configured to stabilize the first user between the lap pad and the wheelchair when the first user is utilizing the adjustable support member.

8. The apparatus of claim 7, wherein the lap pad is pivotable back and forth between a first position where the lap pad extends substantially vertically and a second position where the lap pad extends substantially horizontally.

9. The apparatus of claim 1, wherein the belt is clamped to the adjustable support member.

10. The apparatus of claim 1, wherein the belt is a toothed belt.

11. The apparatus of claim 1, further comprising a sprocket to drive the belt to move the adjustable support member.

12. The apparatus of claim 1, wherein the adjustable support member is configured to adjust between a first position that is vertically above a head of the first user seated in the wheelchair during use, and a second position that is vertically below a knee of the first user seated in the wheelchair during use.

13. The apparatus of claim 12, wherein the adjustable support member is configured to be infinitely adjustable between the first position and the second position.

14. The apparatus of claim 1, including a lap pad configured to stabilize the first user between the lap pad and the wheelchair.

15. The apparatus of claim 14, wherein the lap pad is pivotable back and forth between a first position where the lap pad extends substantially vertically and a second position where the lap pad extends substantially horizontally.

16. The apparatus of claim 14, wherein the lap pad is pivotable about a pivot location on a first side of the first user to selectively engage a support on a second side of the first user that is opposite the first side.

17. The apparatus of claim 1, further comprising a pivotable lap pad configured to stabilize the first user between the lap pad and the wheelchair.

18. The apparatus of claim 17, wherein the lap pad is pivotable back and forth between a first position where the lap pad extends substantially vertically and a second position where the lap pad extends substantially horizontally.

19. The apparatus of claim 17, wherein the lap pad is pivotable about a pivot location on a first side of the first user to selectively engage a support on a second side of the first user that is opposite the first side.

20. A method of exercising when positioned within a wheelchair, comprising:

positioning a user and a wheelchair within an exercise area of an exercise device;

moving a primary handle of the exercise device, the moving of the primary handle resisted by a resistance device;

moving a spotter handle to assist the moving of the primary handle, the spotter handle coupled in movement together with the primary handle; and pivoting a lap pad from a first position where the lap pad extends substantially vertically and a second position where the lap pad extends substantially horizontally, and stabilizing the user between the lap pad and the wheelchair, and exercising using an adjustable support member.

21. The method of claim 20, wherein the moving of the primary handle is a pivoting movement around a first axis, and the moving of the spotter handle is a pivoting movement around a second axis spaced from the first axis.

22. The method of claim 20, comprising moving to another exercise area and automatically adjusting a height of the adjustable support member.

23. The method of claim 20, wherein the adjustable support member comprises an adjustable cable support member.

24. The apparatus of claim 1, wherein the adjustable support member comprises an adjustable cable support member.

* * * * *